United States Patent [19]

Herrmann, Jr.

[11] 4,382,650

[45] May 10, 1983

[54] ANODE CONNECTOR

[75] Inventor: Henry O. Herrmann, Jr., Elizabethtown, Pa.

[73] Assignee: AMP Incorporated, Harrisburg, Pa.

[21] Appl. No.: 230,845

[22] Filed: Feb. 2, 1981

[51] Int. Cl.[3] ..... H01R 11/22; H01R 15/12

[52] U.S. Cl. ..... 339/60 R; 339/61 R; 339/97 R; 339/100

[58] Field of Search ..... 339/258 TC, 97 R, 97 P, 339/98 R, 99 R, 100, 103 R, 200 P, 203, 223 R, 60 R, 61 R

[56] References Cited

U.S. PATENT DOCUMENTS

| | | | |
|---|---|---|---|
| 2,869,100 | 1/1959 | Adams | 339/223 R |
| 3,258,732 | 6/1966 | Martin | 339/59 R |
| 3,406,370 | 10/1968 | Gaw | 339/103 R |
| 3,412,366 | 11/1968 | Pittman | 339/223 R |
| 3,423,718 | 1/1969 | Cea | 339/100 |
| 3,431,544 | 3/1969 | Valle et al. | 339/256 |
| 3,486,162 | 12/1969 | Leitman | 339/256 T |
| 3,689,866 | 9/1972 | Kelly | 339/59 R |
| 3,760,337 | 9/1973 | Johnson | 339/258 TC |
| 3,783,432 | 1/1974 | Biba et al. | 339/74 R |
| 4,155,614 | 5/1979 | Hall | 339/60 R |

FOREIGN PATENT DOCUMENTS

| | | | |
|---|---|---|---|
| 2817105 | 11/1978 | Fed. Rep. of Germany | 339/258 TC |

*Primary Examiner*—John McQuade
*Assistant Examiner*—Gary F. Paumen
*Attorney, Agent, or Firm*—Russell J. Egan

[57] ABSTRACT

An anode connector is disclosed utilizing insulation piercing techniques to effect interconnection of a terminal with a conductor of a high voltage lead. This connector obviates the previous techniques requiring screws for attachment of the terminals and/or the molding in place of pre-terminated conductors resulting in a connector which is impossible to repair. The subject connector includes a molded insulative housing suitably profiled to engage both an anode and a high voltage lead. A terminal according to the present invention is mounted in the housing and receives the high voltage lead therein with the terminal effecting an insulation piercing, conductor engaging termination of the high voltage lead.

6 Claims, 5 Drawing Figures

ANODE CONNECTOR

BACKGROUND OF THE INVENTION

1. The Field of the Invention

The present invention relates to an anode connector and in particular to an electrical connector using insulation piercing to effect termination.

2. The Prior Art

The previously known anode connectors have generally been made in one of two alternate known configurations. One type has a connector formed by molding a housing of insulative material around a pre-terminated high voltage lead. Such a connector can be readily produced but is substantially impossible to repair. The second type of electrical connector is less difficult to produce but requires more assembly steps. This connector usually has a screw which is applied to at least a portion of a terminal to secure it to a high voltage lead conductor or a terminal secured to said conductor.

An example of the molded type of anode connector can be found in U.S Pat. No. 3,406,370 and an example of the screw type of anode connector can be found in U.S. Pat. No. 4,155,614.

SUMMARY OF THE INVENTION

The present invention relates to a low cost anode connector utilizing insulation piercing technology. The subject connector has a molded housing of flexible insulative material defining a lead receiving passage intersected by a terminal receiving passage. A terminal is stamped and formed to include portions for grippingly engaging in the housing and to effect an insulation piercing termination of a high voltage lead inserted into the housing. The terminals can be of either one or two piece construction with the one piece construction including crimp portions to effect a strain relief joining of the lead to the terminal.

It is therefore an object of the present invention to produce an anode connector which does not require molding a connector housing about a pre-terminated high voltage lead.

It is a further object of the present invention to produce an anode connector which utilizes insulation piercing technology to effect termination of a high voltage lead.

It is another object of the present invention to produce an anode connector which utilizes inexpensive stamped and formed terminals which can be readily and economically assembled to a high voltage lead.

It is a further object of the present invention to produce an anode connector which can be readily and economically manufactured.

The means for accomplishing the foregoing objects and other advantages will become apparent to those skilled in the art from the following detailed description taken with reference to the accompanying drawings.

DETAILED DESCRIPTION OF THE PREFERRED EMBODIMENT

Figure 1:
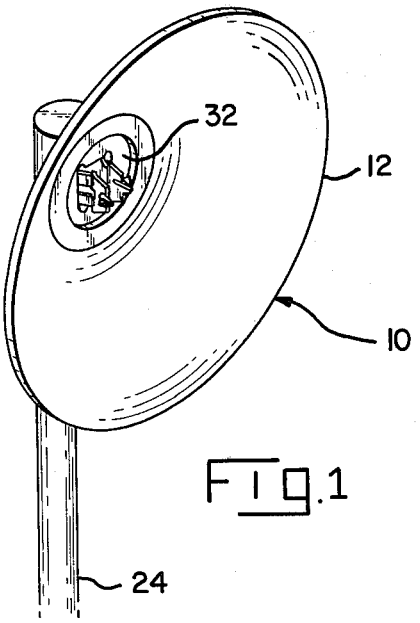
FIG. 1 is a perspective view of an anode connector according to the present invention.

The subject anode connector 10 has a housing 12 formed of a resilient insulative material and includes an integral lead receiving portion 14 which intersects the axis of a truncated conical anode receiving cup 16. The portion 14 includes a bore 18 having radial constrictions 20 and 22 which form a pair of seals for a high voltage lead 24. The bore 18 is intersected by a profiled terminal cavity 26, which includes recess 28 adjacent the bore 18 and annular recess 29 with annular lip 30 opening into the axis of the truncated conical cup 16. The lip 30 is used to retain the slotted metal disc 32, which serves as an X-ray shield.

Figure 3:
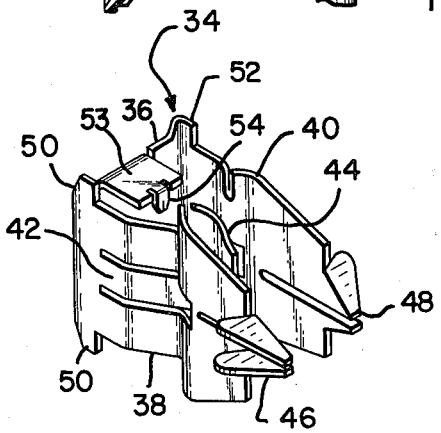
FIG. 3 is a perspective view of the terminal shown in FIG. 2.

The details of the first embodiment of terminal 34 can better be appreciated from the perspective view of FIG. 3. The terminal 34 has a base 36 with a pair of side walls 38, 40 extending generally normally therefrom in spaced relation. Each side wall has an inwardly bent, lead engaging tine 42, 44 anode engaging flanges 46, 48 on the free ends and lateral locking flanges 50, 52 adjacent the base 36. At one lateral end of the terminal there is an upstanding wall 53 having an inwardly directed tine 54 which extends substantially coaxial with the conductor portion (not shown) of the high voltage lead 24 which it engages.

Figure 2:
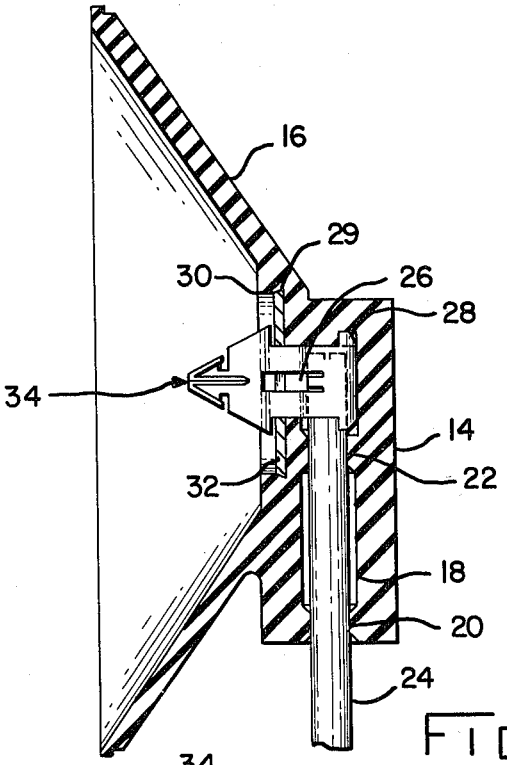
FIG. 2 is a section through the anode connector according to the present invention showing a first embodiment of a terminal.

In this embodiment of the invention the terminal 34 is inserted into the aperture 26 with the flanges 50, 52 of the side walls 38, 40 engaging in recess 28 to hold the terminal 34 in the housing 12. The apertured retaining disc 32 is then applied to the assembly. A high voltage lead 24 would next be inserted through the bore 18, passing through seals 20, 22 until the conductive wire of the lead 24, is penetrated by the tine 54. The tines 42, 44 would then be crimped down to engage the insulation of the lead 24, as shown in FIG. 2.

Figure 4:
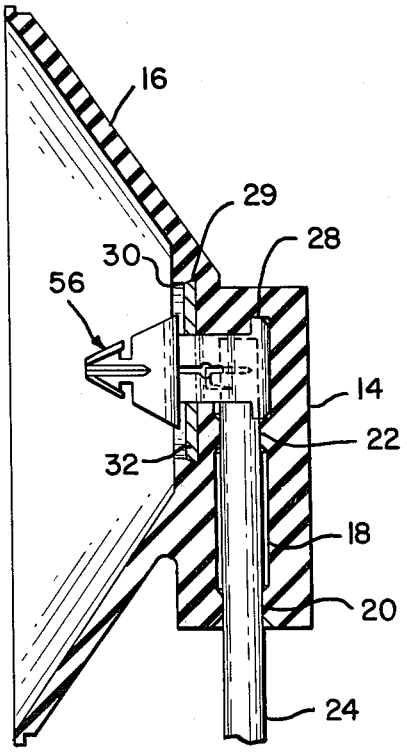
FIG. 4 is a section through the anode connector according to the present invention showing a second embodiment of the terminal.
Figure 5:
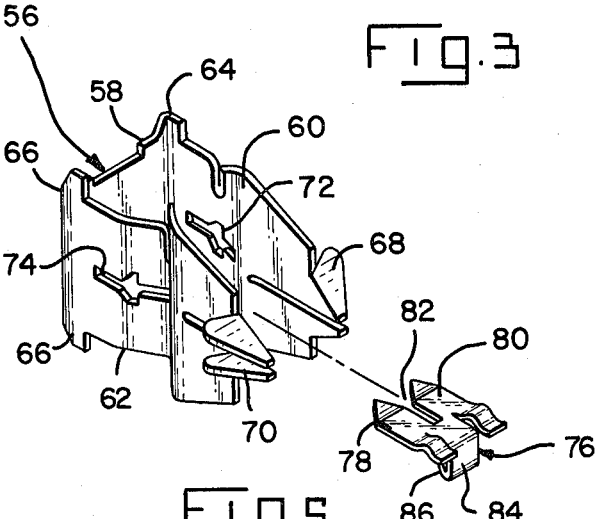
FIG. 5 is a perspective view of the terminal shown in FIG. 4.

The alternate embodiment of the terminal for the present invention is shown in FIGS. 4 and 5. The housing 12 and conductor 24 are identical with the first embodiment. This second embodiment of the terminal 56 is more clearly shown in FIG. 5. The terminal has a base 58 with a pair of spaced upstanding side walls 60, 62 each having a locking flange 64, 66 at the lateral ends, anode engaging flanges 68, 70 at the free ends and a profiled slot 72, 74 intermediate the length thereof. This terminal also has an insert member 76 which has a pair of parallel spaced tines 78, 80 defining a slot 82 therebetween. The plate 76 also has an extension 84 with an insulation gripping lance 86 thereon.

The operation of this terminal 56 is similar to that of the previously discussed terminal 34. In this instance the terminal 56 is mounted in the housing 12 and the high voltage lead 24 is fully inserted, as shown in FIG. 4. At this time the terminal 56 is not making contact with the conductor of the lead. The plate 76 is inserted guided through the slots 72, 74, with tines 78, 80 penetrating the insulation of the lead 24 to engage the conductor thereof in the slot 82. The lance 86 also penetrates into the insulation of the lead to secure the plate and the lead in a locked condition.

The present invention may be subject to many modifications and changes without departing from the spirit or essential characteristics thereof. The present embodiment is therefore to be considered in all respects as illustrative and not restrictive of the scope of the invention.

What is claimed is:

1. An anode connector for terminating a high voltage lead comprising:

a housing of flexible insulative material having a first portion defining a high voltage lead receiving bore, a second integral flange portion with an axis which intersects said bore, and a terminal cavity within said flange portion and opening into said bore; and a terminal received in said cavity directed along said axis, said terminal having a base with a pair of side walls extending substantially normal from opposite sides of said base, a profiled slot in each said sidewall, a plate member to engage a high voltage lead extending through said bore, said plate member having a pair of tines defining an insulation piercing, conductor engaging slot therebetween, edge portions of said plate member received in respective slots of said sidewalls, and means on the free ends of said side walls to engage an anode whereby said tines of said plate member pierce insulation of a high voltage lead to engage a conductor thereof in said slot with edge portions of said plate member engaging in respective slots of said sidewalls.

2. The connector according to claim 1 further comprising:

at least one annular restriction in said lead receiving bore forming a seal for said high voltage lead.

3. The connector according to claim 1 wherein said plate member further comprises:

an integral lance adapted to engage the insulation of said lead providing strain relief therefor.

4. The connector according to claim 1 wherein said flange portion has a truncated conical configuration.

5. The connector according to claim 1 further comprising:

a recess in said terminal cavity adjacent said bore, and at least one flange on said terminal adapted to engage in said recess to secure said terminal in said cavity.

6. The connector according to claim 1 further comprising:

a profiled annular recess concentric with said terminal cavity, and an apertured metal disc received in said annular recess with said terminal projecting through the aperture thereof.

* * * * *